US005507264A

United States Patent [19]

Kugler et al.

[11] Patent Number: 5,507,264

[45] Date of Patent: Apr. 16, 1996

[54] IGNITION SYSTEM FOR INTERNAL COMBUSTION ENGINES WITH MISFIRING DETECTION BY COMPARING THE SAME IGNITION COIL

[75] Inventors: Karl-Heinz Kugler; Karlheinz Riedel, both of Vaihingen, Germany

[73] Assignee: Robert Bosch GmbH, Stuttgart, Germany

[21] Appl. No.: 373,328

[22] Filed: Jan. 19, 1995

[30] Foreign Application Priority Data

May 19, 1993 [DE] Germany ..... 43 16 775.6

[51] Int. Cl.[6] ..... F02P 17/00

[52] U.S. Cl. ..... 123/481; 123/630; 324/388; 324/399

[58] Field of Search ..... 123/479, 481, 123/630, 643; 73/116, 117.2, 117.3; 324/378, 380, 388, 399

[56] References Cited

U.S. PATENT DOCUMENTS 4,117,807 10/1978 Barnard ..... 123/478
4,291,383 9/1981 Tedeschi et al. ..... 73/117.2 X
4,886,029 12/1989 Lill et al. ..... 123/630 X
4,918,389 4/1990 Schleupen et al. ..... 123/630 X
5,334,938 8/1994 Kugler et al. ..... 324/399

FOREIGN PATENT DOCUMENTS 2431799 1/1976 Germany .
2257533 1/1993 United Kingdom .

*Primary Examiner*—Tony M. Argenbright
*Attorney, Agent, or Firm*—Kenyon & Kenyon

[57] ABSTRACT

An ignition system is provided for internal combustion engines for detecting combustion misfirings. The ignition system of an internal combustion engine detects the spark voltage transformed on to the primary side of a double spark coil for evaluating the ignition spark duration and/or the ignition spark voltage so as to allow a comparison to be made with limit values for a correct ignition. The limit values for a correct ignition are determined from the measured variables of a reference ignition. The reference ignition is the ignition which is triggered by the energy potential of the same ignition coil.

11 Claims, 3 Drawing Sheets

IGNITION SYSTEM FOR INTERNAL COMBUSTION ENGINES WITH MISFIRING DETECTION BY COMPARING THE SAME IGNITION COIL

FIELD OF THE INVENTION

The present invention relates to an ignition system for internal combustion engines for monitoring individual ignition processes.

1. Background Information

An ignition system with a monitoring device is already known from German Laid Open Print No. 41 16 642. In this ignition system, the ignition spark duration and ignition spark voltage are detected by detecting the spark voltage transformed onto the primary side and compared with limit values for a correct ignition so that, when faulty combustion is identified, a corresponding fault report signal, for example an optical signal, is output at the dashboard of the vehicle. During this, the limit values for a correct ignition are determined as a function of operating ranges in the application and stored in a memory.

2. Summary of the Invention

In contrast, the ignition system according to the present invention, has the advantage that the limit values for a correct ignition are not permanently prescribed, but are rather adapted to changing conditions, such as to ignition coils having other parameters. Thus, allowance can be made for changed parameters of an ignition coil by adapting the limit values, for example after the ignition coil has been replaced in a service shop and an ignition coil of another manufacturer has been used. As a result, after an ignition coil has been replaced, it does not happen that an ignition fault is incorrectly detected although the ignition was correct, and it also does not happen that a signal for a correct ignition is output while the ignition was faulty. Furthermore, it is advantageous that for reference value generation, for the limit values of a correct ignition, spark-duration and spark voltage measured variables are used, which are measured in a cylinder that is fed by the same ignition coil.

It is particularly advantageous to store the spark-duration and firing-voltage measured values, which are used for the reference value generation, in load classes and r.p.m. classes. Finally, it is advantageous to cyclically update the values for the reference value generation, for example the last ten past values being used for the reference value generation and the oldest value being replaced with the newly measured value after each ignition. For the comparison, it is advantageous to use only the measured values of those cylinders which are fed from the same ignition coil. In the case of an internal combustion engine having rotating distribution, the measured values of all the cylinders can thus be compared, while, when double spark coils are used, for example, only those cylinders are compared with one another, which are fed from this double spark coil.

DETAILED DESCRIPTION OF THE INVENTION

Figure 1:
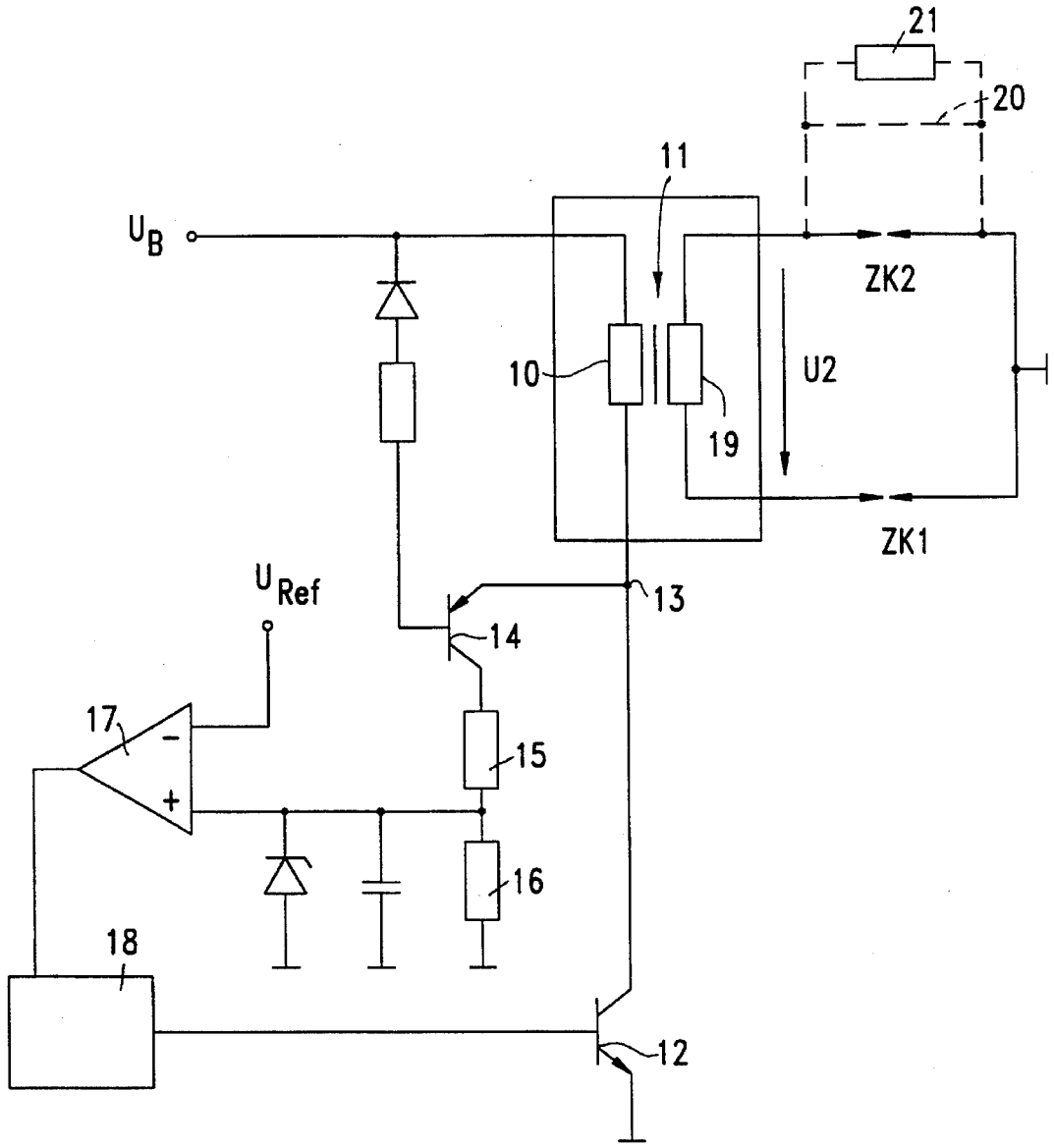
FIG. 1 shows the basic structure for detecting a spark duration and a spark voltage with an ignition circuit according to the present invention having a double spark coil and two spark plugs.

FIG. 1 shows one possible method for detecting and monitoring the voltage at the primary winding 10 of a double spark coil 11. Here, a tap 13, which leads to the emitter of a pnp transistor, is provided between the primary winding 10 and the control transistor 12. The spark voltage induced on the primary side is thus fed via a voltage divider 15/16 to the positive input of a comparator 17. A reference voltage $U_{REF}$, which is prescribed, for example, by a control device 18 for the respective operating state, is applied to the second input of the comparator 17. Thus, a digital signal which corresponds to the spark duration is available at the output of the comparator 17 and is fed to the control device 18. A further possibility is to feed the induced spark voltage directly to the control device 18 via the pnp transistor 14 and the voltage divider 15/16, so as to allow the spark voltage characteristic to be evaluated in addition to the spark duration.

In the case of the illustrated double spark coil 11, spark plugs ZK1 and ZK2 are assigned to each end of the secondary winding 19. The spark plug ZK2 is assigned a connection 20 shown by broken lines and a resistor 21 shown by broken lines. The purpose of these illustrations 20 and 21 is to clarify a shunt resistance across the spark plug ZK2, which resistance is built up, for example, spark-plug contamination.

Figure 2A:
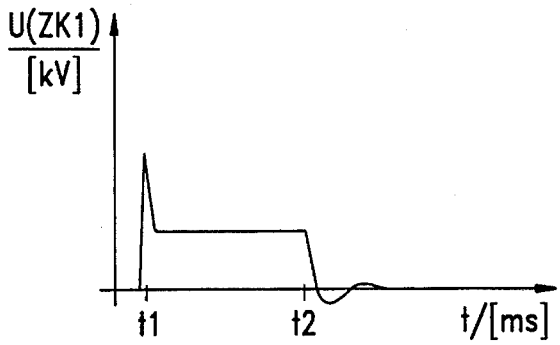
FIG. 2*a* shows a voltage characteristic across a first spark plug shown in FIG. 1 during a power (firing) stroke.
Figure 2B:
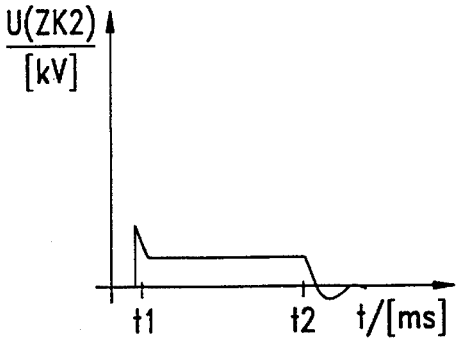
FIG. 2*b* shows a voltage characteristic across a second spark plug shown in FIG. 1 during an exhaust stroke.

FIG. 2 shows the voltage characteristic across the spark plugs ZK1 and ZK2 during a combustion, FIG. 2*a* showing the voltage characteristic U(ZK1) of the spark plug ZK1 which is in the power (firing) stroke and FIG. 2*b* showing the voltage characteristic U(ZK2) of the spark plug ZK2 in the exhaust stroke. Here, it is clear that the spark voltage in the power stroke is considerably larger than in the exhaust stroke, due to the gas mixture and response voltage of the spark plugs, while, however, the spark durations t1 to t2 are approximately the same.

In FIGS. 3 and 4, the voltage characteristic across the spark plugs is illustrated in each case, while there is a ground connection at the spark plug ZK2, the spark plug ZK2 with the earth connection in FIG. 3 being in the exhaust stroke and in the power stroke in FIG. 4.

Figure 3A:
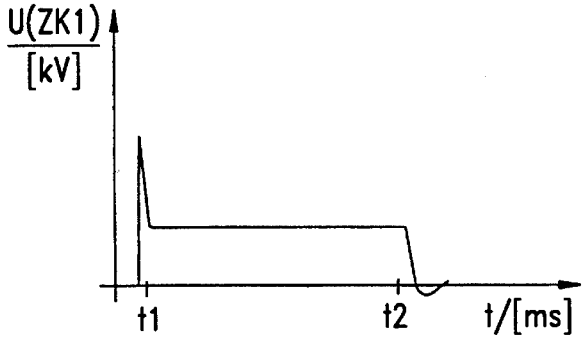
FIG. 3*a* shows a voltage characteristic across the first spark plug shown in FIG. 1 during a power stroke when there is a ground connection at the second spark plug.
Figure 3B:
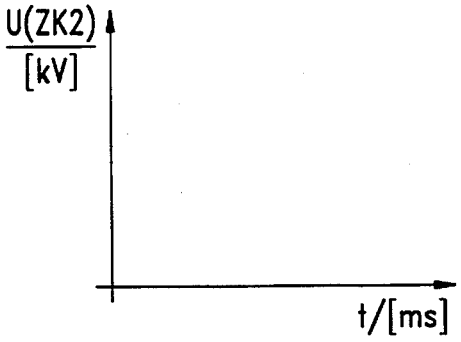
FIG. 3*b* shows a voltage characteristic across the second spark plug shown in FIG. 1 during an exhaust stroke when there is a ground connection at the second spark plug.

FIG. 3*a* shows the voltage characteristic u(ZK1) across the spark plug ZK1 in the power stroke, while in FIG. 3*b*, the spark plug ZK2 with the ground connection is in the exhaust stroke. Since no energy is converted at the spark plug ZK2, but the same amount of energy is available as during normal operation, the spark duration t1 to t2 will be longer.

Figure 4A:
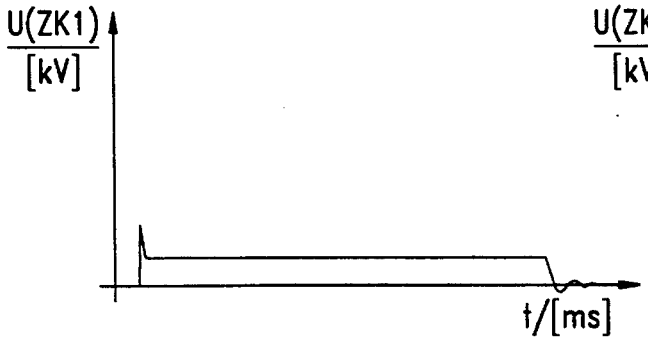
FIG. 4*a* shows a voltage characteristic across the first spark plug shown in FIG. 1 during an exhaust stroke when there is a ground connection at the second spark plug.
Figure 4B:
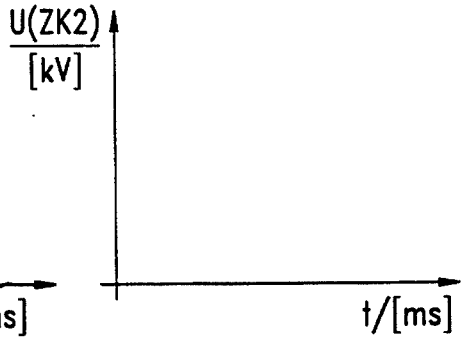
FIG. 4*b* shows a voltage characteristic across the second spark plug shown in FIG. 1 during a power stroke when there is a ground connection at the second spark plug.

In FIG. 4*b*, the power stroke at spark plug ZK2 with the ground connection cannot contribute to the voltage characteristic; however, since the energy for normal operation is also available here and the breakdown voltage and spark voltage at the spark plug ZK1 in FIG. 4*a* are very low in the exhaust stroke, the spark duration t1 to t2 becomes considerably longer than in normal operation.

Figure 5:
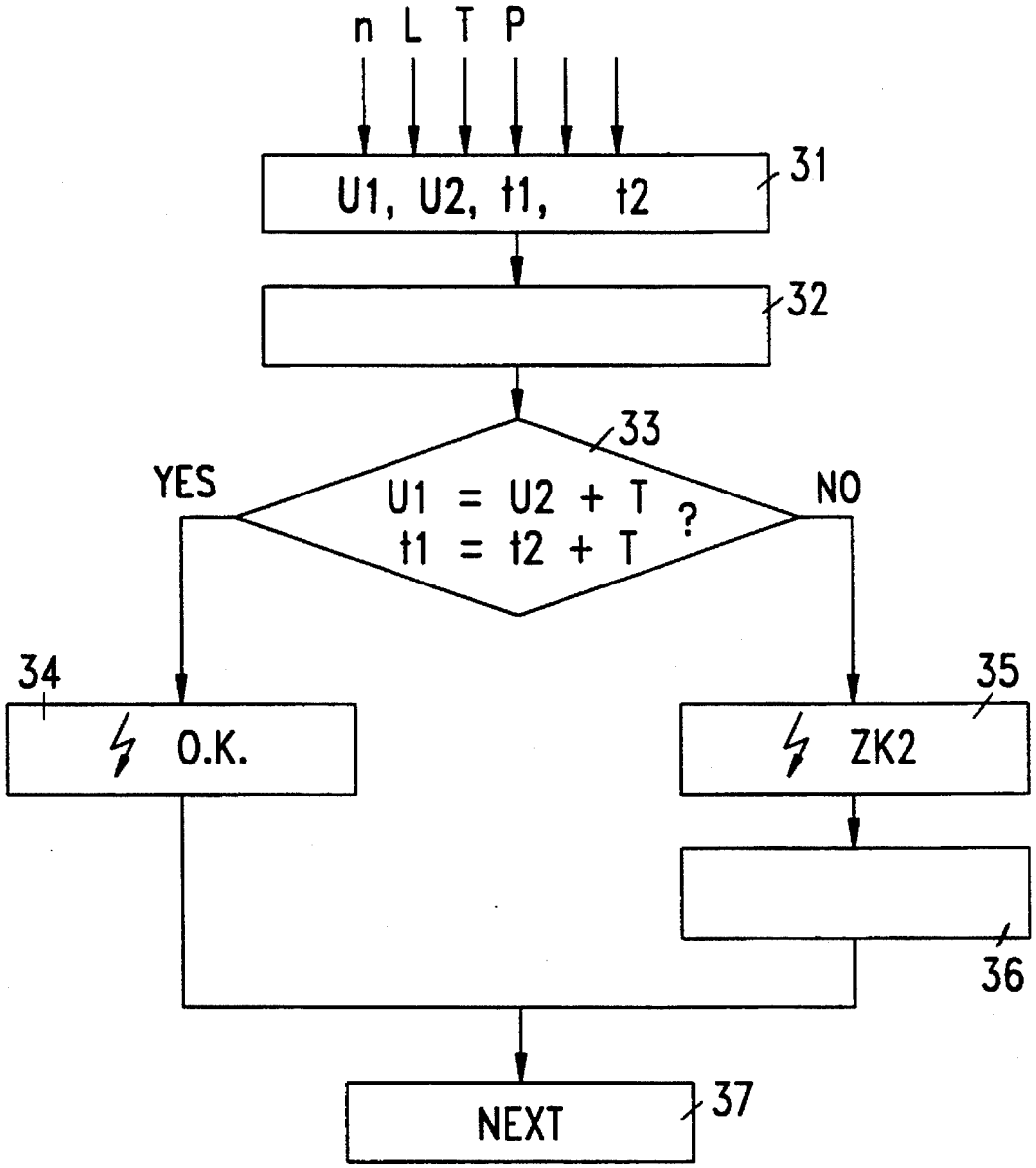
FIG. 5 is an illustrative flowchart for a method of fault detection according to the present invention.

In FIG. 5, the individual process steps for carrying out the method of the present invention are illustrated schematically. In the power step 31, the spark voltages U1 and U2, as well as the time of breakdown ignition, and the time of the end of the spark are detected to determine the spark duration t1 to t2. In the work step 32, these detected values are assigned to the respective load or rpm and then stored as evaluated values in tables.

In the subsequent query 33, it is checked whether the detected spark-voltage and spark-duration values, associated with one ignition coil, are approximately the same while taking into account an applicable tolerance variable T. If the query 33 was able to be answered with yes, thus if the measured variables correspond to the previously generated reference values, then the Yes output leads to a work step 34 in which the ignition is evaluated as being correct. A No in response to the query 33 leads to the work step 35 in which the queried ignition is evaluated as being faulty. In a subsequent work step 36, fault measures are introduced, such as switching off the injection in this cylinder or increasing the voltage supply at the ignition coil, so as to allow the spark plug to possibly self-clean. At the same time, it is possible to output an optical or acoustical error information for the driver of the internal combustion engine or to store the fault. In the following work step 37, the next ignition is checked in an analogous fashion.

Important in the case of the applied method is that, in each case, only those acquired measured values of an ignition are compared which are triggered by the same ignition coil. In an internal combustion engine having a rotating distribution, the measured values of all cylinders could thus be compared with one another while, for example, in ignition coils having double spark coils, only those cylinders can be compared which are assigned to one and the same ignition coil.

What is claimed is:

1. An ignition system for controlling ignition during a first combustion cycle of an internal combustion engine, comprising:

at least one ignition coil having a primary winding and a secondary winding, the secondary winding having a high-voltage end;

a spark plug connected to the high-voltage end of the secondary winding;

a control switch connected in series with the primary winding, a tap being attached between the primary winding and the control switch for detecting first and second spark voltages transformed onto the primary winding, the first spark voltage corresponding to the first combustion cycle, the second spark voltage corresponding to a second combustion cycle prior to the first combustion cycle;

an evaluation circuit coupled to the primary winding for determining at least one limit value indicating a correct combustion of the internal combustion engine as a function of the detected second spark voltage, and for comparing the detected first spark voltage with the at least one limit value.

2. An ignition system for an internal combustion engine, comprising:

a double spark coil having a primary winding and a secondary winding, the secondary winding having a first end and a second end;

a first spark plug connected to the first end;

a second spark plug connected to the second end;

a control switch connected in series with the primary winding, a tap being attached between the primary winding and the control switch for detecting a spark voltage transformed onto the primary winding;

an evaluation circuit coupled to the primary winding for comparing the detected spark voltage with at least one limit value indicating a correct combustion of the internal combustion engine; and wherein the at least one limit value is determined as a function of the detected spark voltage from at least one preceding combustion cycle.

3. The ignition system according to claim 2, wherein a preselected number of preceding combustion cycles are used to establish the at least one limit value.

4. The ignition system according to claim 2, wherein the detected spark voltage indicates the correct combustion of the internal combustion engine when the detected spark voltage deviates from the at least one limit value by a predetermined tolerance value.

5. The ignition system according to claim 4, wherein the detected spark voltage is used to determine at least one of an ignition spark duration and an ignition spark voltage.

6. A method for determining a correct combustion of an internal combustion system, the internal combustion engine having at least one ignition coil coupled to at least one spark plug, the method comprising the steps of:

determining a first spark voltage across the at least one spark plug and a first spark duration of the at least one spark plug;

determining a second spark voltage across the at least one spark plug and a second spark duration of the at least one spark plug;

comparing the first spark voltage with the second spark voltage;

comparing the first spark duration with the second spark duration;

if the second spark voltage is within a first predetermined tolerance factor of the first spark voltage and the second spark duration is within a second predetermined tolerance factor of the first spark duration, providing a first signal indicating the correct combustion of the internal combustion engine; and if at least one of the second spark voltage differs from the first spark voltage by an amount greater than the first predetermined tolerance factor and the second spark duration differs from the first spark duration by an amount greater than the second predetermined tolerance factor, providing a second signal indicating a faulty combustion of the internal combustion engine.

7. The method according to claim 6, further comprising the step of initiating a fault measure in response to the second signal.

8. The method according to claim 6, wherein the first spark voltage and the first spark duration are determined as a function of a spark voltage transformed onto the at least one ignition coil from at least one previous combustion cycle of the internal combustion engine.

9. The method according to claim 8, wherein a preselected number of preceding combustion cycles are used to establish the first spark voltage and the first spark duration.

10. The method according to claim 9, wherein the at least one spark coil includes a double spark coil having a primary winding and a secondary winding, the secondary winding having a first end and a second end, and wherein the at least one spark plug includes a first spark plug connected to the first end of the secondary winding and a second spark plug connected to a second end of the secondary winding.

11. The method according to claim 7, wherein the fault measure includes at least one of switching off an injection of fuel to a cylinder corresponding to the at least one spark plug associated with the second signal and increasing a voltage supply to the ignition coil.

* * * * *